United States Patent [19]

Siverson et al.

[11] Patent Number: 4,664,030

[45] Date of Patent: May 12, 1987

[54] SIMULTANEOUS MULTISURFACE DIFFUSION PRINTER

[75] Inventors: Ronald A. Siverson, Coeur d'Alene, Id.; Jay A. Clark, Spokane, Wash.

[73] Assignee: Advanced Input Devices, Inc., Couer d'Alene, Id.

[21] Appl. No.: 782,084

[22] Filed: Sep. 30, 1985

[51] Int. Cl.[4] ..... B41F 17/24

[52] U.S. Cl. ..... 101/41; 101/407 R; 400/490; 8/470; 428/206

[58] Field of Search ..... 101/35, 41, 407 R, 407 BP, 101/470; 400/490, 493; 8/467, 470, 471, 506; 156/580, 583.1; 428/195, 207

[56] References Cited

U.S. PATENT DOCUMENTS

| | | | |
|---|---|---|---|
| 2,124,711 | 7/1938 | Rowell | 101/41 |
| 4,040,889 | 8/1977 | Acda | 156/580 |
| 4,163,421 | 8/1979 | Sihotg | 101/407 R |
| 4,377,428 | 3/1983 | Toth | 156/580 |
| 4,587,155 | 5/1986 | Durand | 400/490 |

FOREIGN PATENT DOCUMENTS

| | | | |
|---|---|---|---|
| 155957 | 9/1983 | Japan | 400/493 |
| 41292 | 3/1984 | Japan | 101/470 |
| 91089 | 5/1984 | Japan | 101/470 |
| 199251 | 11/1984 | Japan | 400/490 |

OTHER PUBLICATIONS

"Hot Transfer Vacuum Conformal Press Mechanism for Keybutton Legends"; R. H. Harris; *IBM Tech. Disc. Bull.;* vol. 23, No. 9, pp. 4235–4237; Feb. 1981.

*Primary Examiner*—Edgar S. Burr
*Assistant Examiner*—David A. Wiecking
*Attorney, Agent, or Firm*—Christensen, O'Connor, Johnson & Kindness

[57] ABSTRACT

Simultaneous multisurface diffusion printing of indicia into the top and front surfaces of the assembled keys (39) of a keyboard (41) is disclosed. The bottom (29) of a fixture (23) supports a plurality of spring-loaded pedestals (37) for the keys (39) to be imprinted. A locator plate (27) maintains the keys (39) in a fixed position and functions as a heat shield. Positioned above the locator plate (27) is a sheet of transfer paper (61) having an array of reverse image indicia (63) which are located at positions in alignment with the top and front surfaces of the keys (39) to be imprinted. U-shaped incisions (65) allow the portion of the indicia to be imprinted on the front surface of a key to be bent away from the plane of the transfer sheet. Positioned above the locator plate (27) is a printing plate (73) having different shape protrusions (75*a* and 75*b*) to impinge on at least the two surfaces of the keys (39) to be imprinted. The printing plate (73) is attached to the bottom of a heated platen (15) that overlies the table (13). The heated protrusions (75) press the indicia regions (63) of the transfer paper (61) against the individually upwardly biased keys (39) to be imprinted causing the indicia (63) to be diffusion printed into these surfaces.

12 Claims, 8 Drawing Figures

73
77
75
71
67
69
65
61
51
47
49
27
39
43
33
35
45
41
37
31
29
25
32

SIMULTANEOUS MULTISURFACE DIFFUSION PRINTER

TECHNICAL AREA

This invention relates to imprinting indicia on the keys of keyboards and, more particularly, the creation of indicia in the top and front surfaces of the keys of keyboards.

BACKGROUND OF THE INVENTION

The surfaces of the keys of most keyboards, such as computer keyboards, bear identifying indicia—letters, numbers, symbols, or a combination thereof. Some keys include several indicia, each representing a different function. The state of a function control key, such as the shift key determines which of the functions a multifunction key is to perform and, thus, which indicia denotes the operative key function. As more functions are assigned to particular keys, more and more indicia are added. In order to separate indicia, some keyboards include function identifying indicia on the front as well as the top surface of the keys of the keyboard. This invention is directed to the creation of the function identifying indicia located on the top and front surfaces of the keys of a keyboard.

In the past, keyboard indicia have been created by various techniques. At one end of the spectrum of techniques lie expensive two-shot molding techniques (which create deeply imbedded, long wearing indicia). At the other end lie relatively inexpensive surface printing techniques (which create a surface image that wears away with time and use). Recently, keyboard manufacturers have begun to use dry diffusion printing techniques to create indicia in the tops of the keys. This technique has the advantages of creating diffused indicia images whose wear life is considerably greater than surface printed images at a cost substantially less than the cost of two-shot molding. In dry diffusion printing, a transfer paper onto which the image has been preset is pressed against the top of the key that is to receive the indicia. The pressure plus heat results in the dye that forms the indicia image being transferred from the transfer sheet to the key. A recently developed diffusion printer, described in U.S. patent application Ser. No. 725,924, filed Apr. 22, 1985, now abandoned and refiled as Ser. No. 888,646 on July 24, 1986 and entitled "Double Shuttle Diffusion Printer" by Brian K. Neil, assigned to the assignee of the present application, transfers images to several keys (including an entire keyboard) simultaneously. During transfer, the dry dye crystals that form the image sublimate upon heated contact with the resin that forms the key. That is, the dry dye crystals change directly from a solid form into a gas and back into a solid without going through a liquid phase. The attraction force between the dry dye crystals and the resin molecules "pull" the image onto the top surface of the keys. The end result of this migration is a sharp, abrasion-proof image infused to a depth of 4–6 mils. Since dry dye crystals are transferred directly from a pattern preset on the transfer paper, multicolored images can be transferred in a single step.

In the past, dry diffusion printing machines of the type described in the patent application referenced above, have been only able to apply images to the top surface of the keys. Other techniques have been required to apply images to the front surface of the keys of a keyboard. One method involves a wet printing process that uses epoxy or solvent based inks. The front surface of multifunction keys are individually printed in fixtures and, then, assembled into the keyboard. The entire keyboard is then top surface printed in a printer of the type described in the patent application referenced above. Because this procedure is labor intensive, it is expensive. Further, the repetitive nature resulting from printing individual keys and then assembling them in a keyboard in a particular location makes the probability of error high. The present invention is directed to avoiding these and other problems by providing an improved dry diffusion printing machine that simultaneously prints indicia into the top and one of the side (e.g., the front) surfaces of the assembled keys of a keyboard.

SUMMARY OF THE INVENTION

In accordance with this invention, an improved diffusion printer that simultaneously imprints indicia into the top and one of the side, such as the front, surfaces of the assembled keys of a keyboard is disclosed. The assembled keys and the frame that supports the keys are mounted in a fixture. Overlying the fixture is a sheet of transfer paper having an array of reverse image indicia formed by dry dye crystals on its lower surface. The reverse image indicia are located at positions in alignment with the top and side surfaces of the keys to be imprinted. Each indicia location is separated from the body of the sheet of transfer paper by an incision that allows the portion of the indicia to be imprinted into the side surface of a key to be bent away from the plane of the sheet. Positioned above the sheet of transfer paper is a printing plate having protrusions in alignment with the indicia and the keys to be imprinted. The protrusions are configured so as to impinge on the top and the side surfaces of the keys to be imprinted. The fixture is supported by the table of a press and the printing plate is attached to the bottom of a heated platen that overlies the table. When the platen is lowered, the heated protrusions press the indicia regions of the transfer paper against the top and side surfaces of the keys to be imprinted causing the indicia to be diffusion printed into these surfaces.

As will be readily appreciated from the foregoing description, this invention provides an improved dry diffusion printing machine that simultaneously imprints indicia into the top and side (e.g., front) surfaces of the keys of an assembled keyboard. The incisions formed around the transfer paper images allow the portion of the images to be imprinted into the front surface of the keys to be bent away from the plane of the transfer paper and pressed against the front surfaces of the keys by the portion of the printing plate protrusions that are configured to impinge on the front surfaces of the keys. The thusly created pressure, plus the heat of the platen, causes the dry dye crystals that form the images to sublimate and, then, migrate into the front surface of the keys at the same time images are transferred into the top surface of the keys in the same way. Because simultaneous image transfer takes place, blank keys can be inserted into the keyboard support structure. As a result, the labor associated with separately printing the front surfaces of keys requiring indicia on the front surfaces prior to assembling the keys in the keyboard is avoided. Further, the time needed to assemble blank keys is normally less than the time needed to assemble keys with front surface indicia since less thought is involved. Moreover, the probability of error is eliminated. Hence, the invention overcomes the disadvantages discussed above.

BRIEF DESCRIPTION OF THE DRAWINGS

The foregoing and other advantages of the invention will become more readily appreciated as the same becomes better understood by reference to the following detailed description when taken in conjunction with the accompanying drawings wherein.

DESCRIPTION OF THE PREFERRED EMBODIMENT

Figure 1:
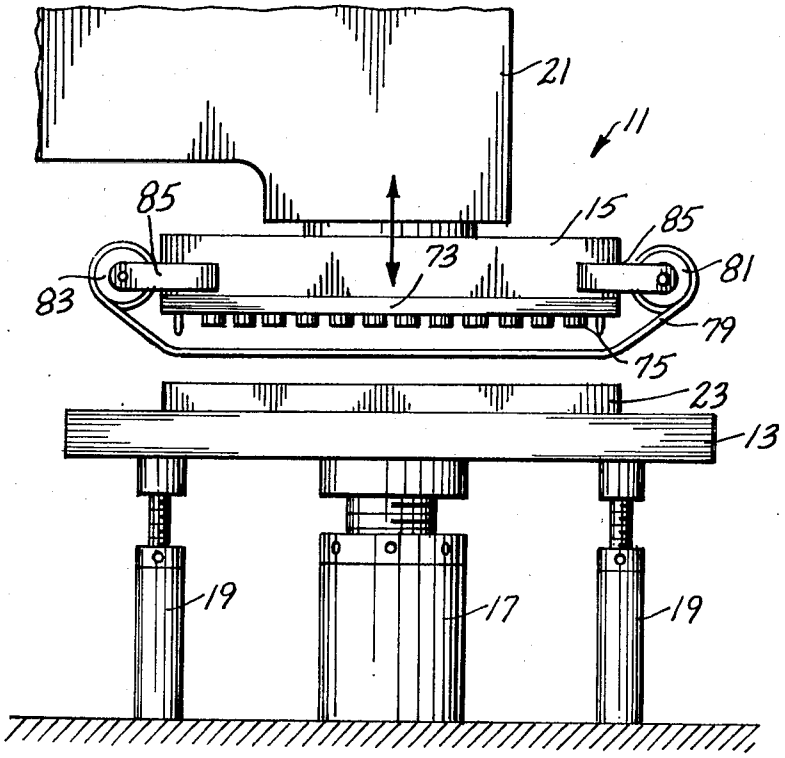
FIG. 1 is a side elevational view of a dry diffusion printer.

FIG. 1 illustrates a dry diffusion printer modified in accordance with the invention. The dry diffusion printer includes a press 11 having a table 13 that underlies a heated platen 15. The table is supported by a center table support column 17 and outboard table support columns 19. The heated platen 15 is mounted on an upper arm 21 that is vertically movable toward and away from the table 13, as shown by the vertical arrow. A press of the type illustrated in FIG. 1 in combination with a mechanism for moving an entire keyboard assembly held in the hereinafter described fixtues into and out of a printing position located between the table 13 and the platen 15, is described in more detail in U.S. patent application Ser. No. 725,924, filed Apr. 22, 1985, and entitled "Double Shuttle Diffusion Printer" by Brian K. Neil, that set forth the same details here. The information contained in U.S. patent application Ser. No. 725,924 is hereby incorporated herein by reference.

Figure 2:
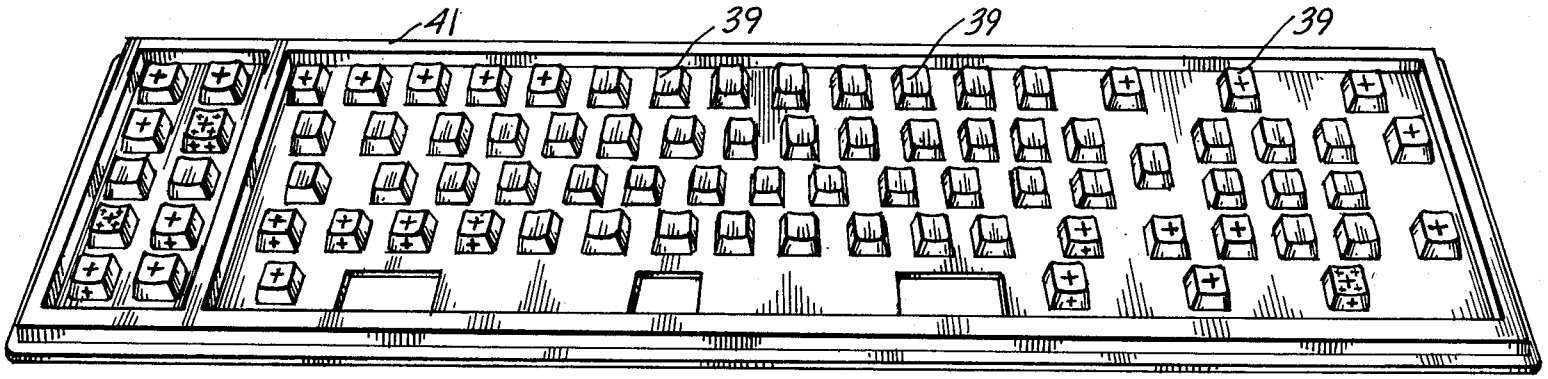
FIG. 2 is a pictorial view of a keyboard showing the location of indicia on the top and front surfaces of keys.
Figure 3:
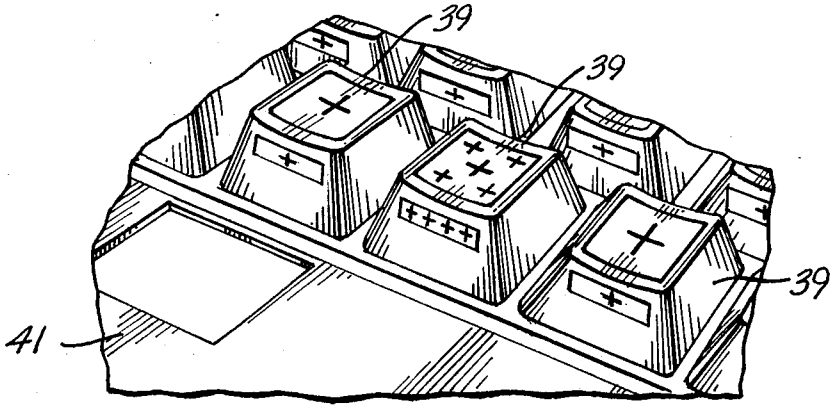
FIG. 3 is an enlarged view of a portion of FIG. 2.

While the double shuttle diffusion printer described in U.S. patent application Ser. No. 725,924 constituted a significant step forward in the keyboard indicia printing act, it only provided for indicia printing on the tops of the keys of a keyboard. It did not provide for printing indicia on other surfaces of keys. In this regard, many keyboards, such as computer keyboards, include keys that are multifunction keys. The depression of such keys cause different functions to occur, depending upon the status of one or more function control keys. Each multifunction key includes indicia depicting the functions that can be performed by the key. In some keyboards, the indicia are all located on the top surfaces of the keys. Discrete locations and/or colors separate the various functions of the keys. In other keyboards, the same or additional functions are denoted by indicia located on the front surfaces of the keys. FIGS. 2 and 3 are pictorial views of such keyboards wherein the plus (+) symbol is used to depict various possible indicia locations. The present invention is directed to providing a diffusion printer of the type generally illustrated in FIG. 1 for simultaneously printing indicia on multiple surfaces of the keys of an assembled keyboard.

Figure 4:
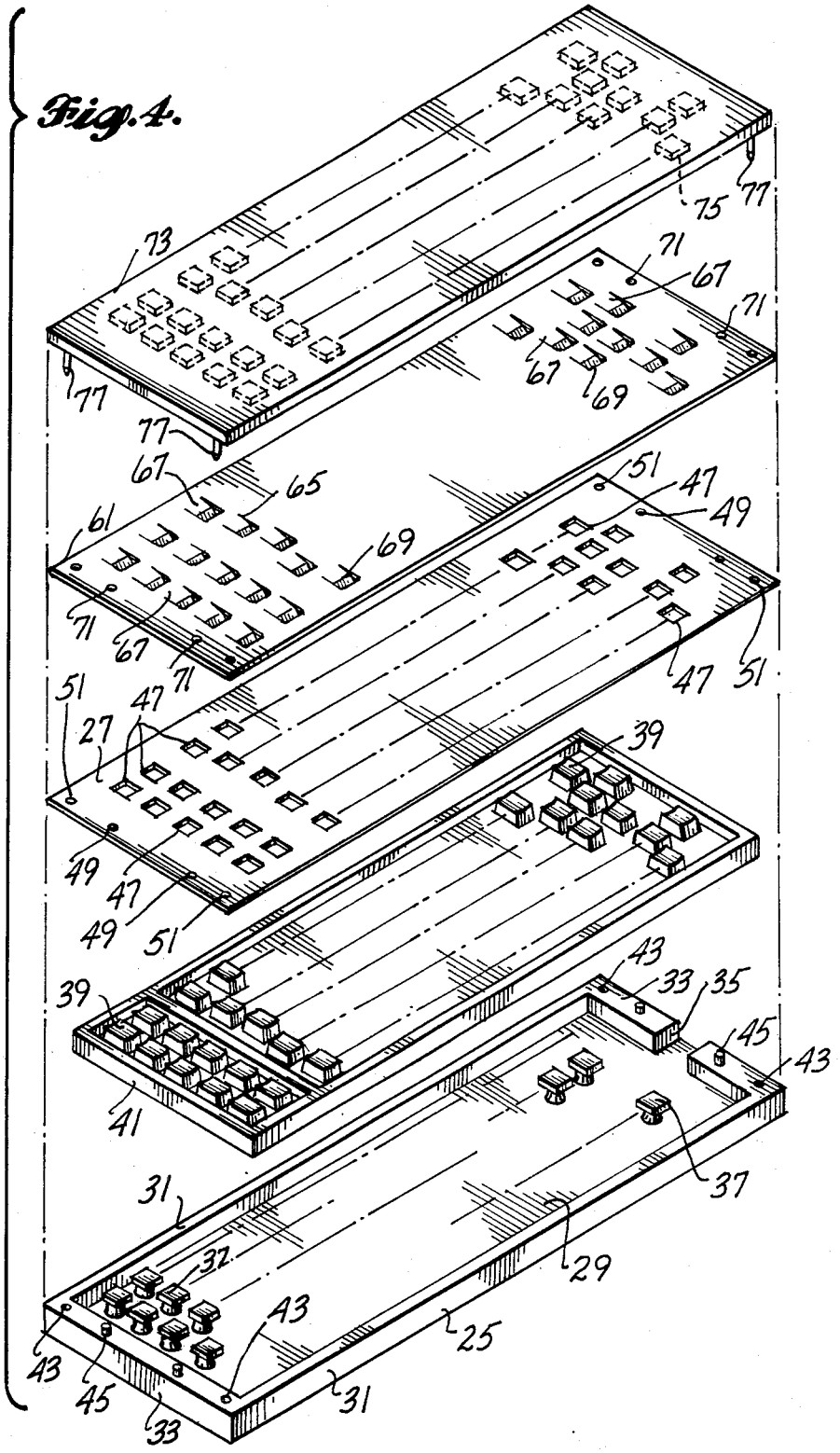
FIG. 4 is an exploded view of a base fixture, keyboard, locator plate, indicia transfer paper and printing plate assembly.

Returning now to FIG. 1, mounted on the table 13, beneath the platen 15, is a fixture 23. As illustrated best in FIG. 4, each fixture 23 includes a fixture base 25 and a key cap locator plate 27. The fixture base 25 is in the form of an open topped tray that includes a bottom 29, a pair of sidewalls 31 and a pair of end walls 33, one of which may include an access cutout 35. The bottom 29 of the fixture base 25 is located on the table 13 in a precise position with respect to the platen 15.

Attached to the bottom 29 of each fixture base 25 are a plurality of spring-loaded pedestals 37. The pedestals are positioned so as to be aligned with the keys 39 of a keyboard 41 that are to receive indicia during the printing sequence, when the keyboard 41 is mounted in the fixture base 25. Preferably, each spring-loaded pedestal includes a flat cap mounted atop a coil spring that is attached to the bottom 29 of the fixture base 25.

The fixture base 25 is formed of a suitable high temperature material, such as a high temperature plastic—a phenolic resin based plastic, for example. Formed in the top of the end walls 33 of the fixture base 25 near the ends thereof, are vertical guide holes 43. Extending upwardly from the tops of the end walls 33, inward of the vertical guide holes 43, are alignment pins 45.

After a keyboard 41 is mounted in a fixture base 25 such that it is surrounded by the sidewalls 31 and the end walls 33 and such that the spring-loaded pedestals 37 impinge on the bottoms of the keys 39 to receive indicia, the key cap locator plate 27 is positioned atop the side and end walls. The key cap locator plate 27 is formed of a stiff, rectangular sheet of poor heat conductive material (such as fiberglass or Bakelite) that includes holes 47 positioned and sized to receive and surround each of the keys 39 to receive indicia. Located along the edges of the key cap locator plate 27 are alignment pin holes 49 positioned and sized to receive the alignment pins 45 that extend upwardly from the end walls 33 of the fixture base 25. When the key cap locator plate 27 is positioned atop the side and end walls 31 and 33 of the fixture base 25 such that the pins 45 of the fixture base 25 pass through the alignment pin holes 49 formed in the edge of the key cap locator plate 27, the keys 39 are precisely positioned. Located in the corners of the key cap locator plate 27 so as to be alignable with the alignment holes 43 located in the corners of the fixture base 25 are locator plate alignment holes 51.

Figure 5:
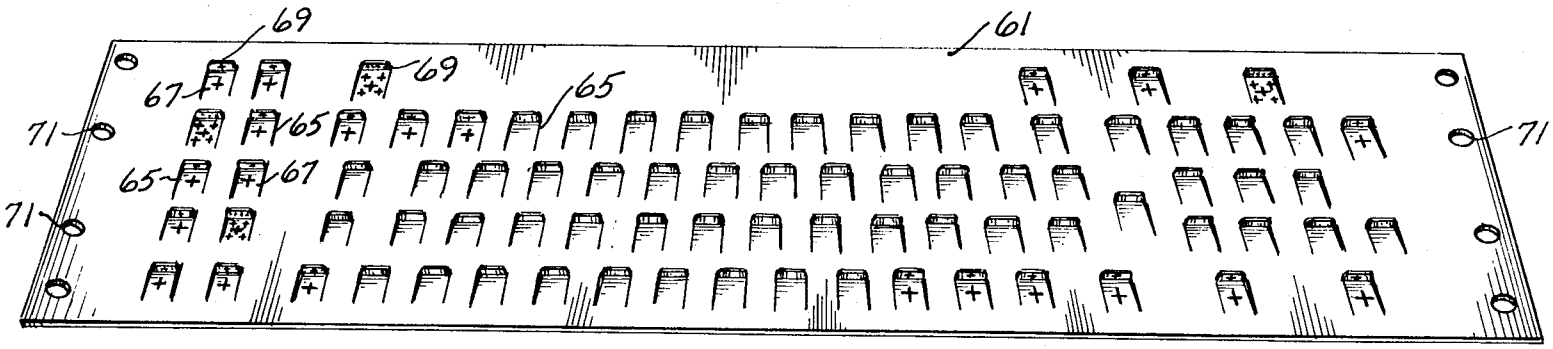
FIG. 5 is a pictorial view of the bottom side of indicia transfer paper formed in accordance with the invention.
Figure 6:
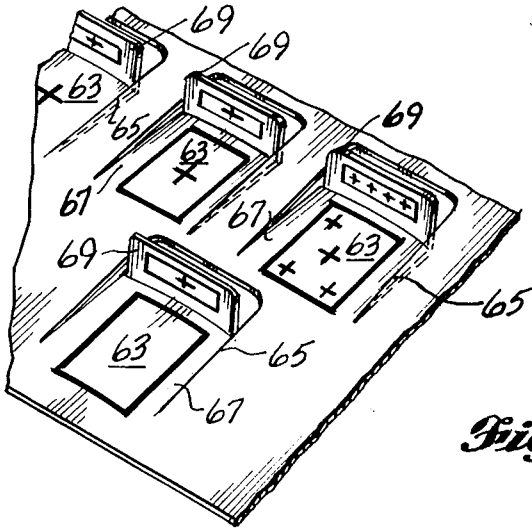
FIG. 6 is an enlarged view of a portion of FIG. 5.

Positioned above the fixture formed by the fixture base 25 and the key cap locator plate 27 is a sheet of transfer paper 61. As best illustrated in FIGS. 5 and 6, the sheet of transfer paper 61 is rectangular and includes a plurality of precisely positioned dry dye regions 63 that include reverse images of the indicia to be created on the top and front surfaces of the keys 39 of the keyboard 41. More specifically, each of the indicia regions 63 is separated from the body of the sheet of transfer paper 61 by an incision 65. The incisions 65 are U-shaped. As a result, each indicia region 63 lies in a tab 67 attached to the main body of the sheet of transfer paper 61. The portion of each tab 67 containing an indicia to be printed on the front surface of a key 39 is bent outwardly to form a flap 69. Alignment of the transfer paper 61 is accomplished by positioning the transfer paper 61 such that the alignment pins 45 that extend upwardly from the end walls 33 of the fixture base 25 pass through alignment holes 71 located along the edge of the transfer paper 61. When appropriately aligned, the main part of each tab 67 overlies the top surface of the key 39 that is to receive the indicia located on the main part of the tab and the flap 69 is aligned with the front surface of the key.

Under pressure and heat, the dry dyes held by the transfer paper sublimate. That is, the dry dyes change directly from a solid form to a gas and back into a solid again without going through a liquid stage. Attractive forces between the dye and the resin molecules of the keys "pull" the image into the keys to a depth of 4–6 mils. As a result images are printed by the diffusion of the dye into the keys.

Heat and pressure are applied to the transfer paper and the keys to cause diffusion printing by the platen 15 of the press 11 via a printing plate 73 mounted on the bottom of the platen 15. The printing plate 73 is formed of a flat, thick sheet of heat conducting material, such as aluminum or steel. Projecting outwardly from the bottom surface of the printing plate 73 are a plurality of protrusions 75 positioned to be aligned with the keys 39 to receive an indicia from the transfer paper 61. The key protrusions 75, which are described more fully below, may be formed by the precise machining of the printing plate material. Located in each of the corners of the printing plate 73 are leader pins 77. The leader pins 77 are positioned so as to be alignable with the vertical alignment holes 43 formed in the end walls 33 of a fixture base 25 when a fixture base is suitably aligned beneath the printing plate 73.

Figure 7:
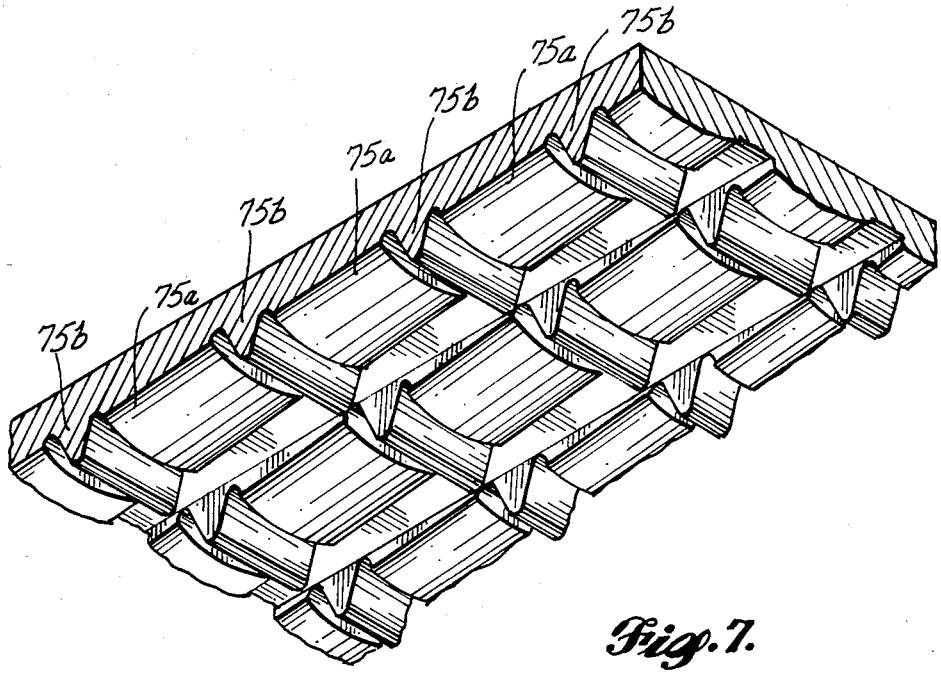
FIG. 7 is a pictorial view of the bottom side of a portion of a printing plate formed in accordance with the invention; and, FIG. 8 is a cross-sectional view illustrating a printing plate of the type illustrated in FIG. 7 pressing the image regions of transfer paper of the type illustrated in FIGS. 5 and 6 against the top and front surfaces of the keys of a keyboard of the type illustrated in FIGS. 2 and 3.
Figure 8:
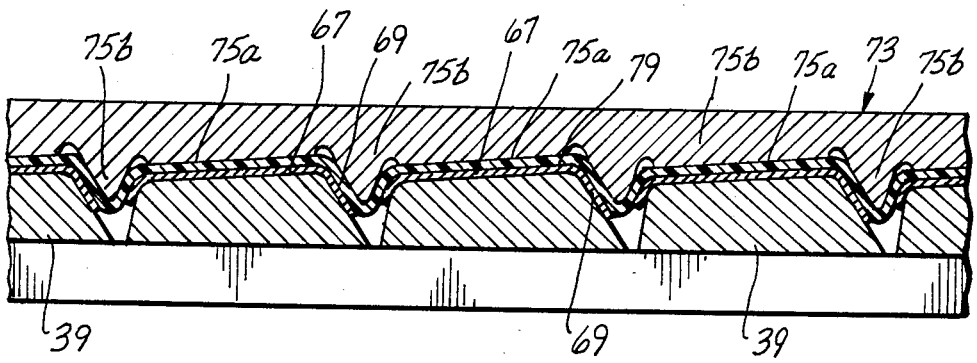

As best shown in FIGS. 7 and 8 the key protrusions 75 actually comprise a convex protrusion **75*a* positioned to impinge on the top surfaces of the keys 39 to receive indicia and wedge protrusions 75*b* having one side positioned to impinge on the front surface of one key and the back surface of the immediately adjacent key. The convex protrusions and the side of the wedge protrusions that impinge on the front surfaces of the keys provide the source of pressure and heat needed to cause diffusion printing of the indicia into the top and front surfaces of the keys 39**.

Located between the printing plate protrusions 75 and the transfer paper 61 is a rubber blanket 79 (FIGS. 1 and 8). The rubber blanket, which may be formed of 1/32 inch silicone rubber, runs from a feed roller 81 located on one side of the platen 15 to a take-up roller 83 located on the opposite side of the platen. The supply and take-up rollers 81 and 83 are supported by arms 85 that extend horizontally outwardly from the sides of the platen 15. The rubber blanket compensates for any slight irregularities in the face of the printing plate protrusions 73. The rubber blanket also provides a renewable clean surface that is used to avoid the printing contamination that would occur as a result of the dye particles collected by the blanket during printing if the same surface were continuously used.

In operation, the fixture base 25 is first filled with a keyboard 41. After the keyboards 41 have been suitably positioned in the fixture bases 25, a key cap locator plate 27 is mounted atop the fixture bases 25 in the manner heretofore described, i.e., such that each key 39 to be imprinted passes through a locator hole 47 in the key cap locator plate and such that the alignment pins 45 formed in the end walls 33 of the fixture bases 25 pass through the alignment pin holes 49 formed in the key cap locator plate. Thereafter, a sheet of transfer paper 61 is laid face down atop the key cap locator plate 27 such that the alignment pins 45 formed in end walls 33 of the fixture base 25 pass through the transfer paper alignment holes 71 and such that the appropriate indicia dyes are aligned with the keys that are to receive the dye images.

Next, the filled fixture base is positioned between the platen 15 and the table 13. Thereafter, the button of a start switch (not shown) is depressed causing the platen to be lowered. As the platen lowers, the leader pins 77 formed in the printing plates 73 enter the vertical alignment holes 43 formed in the end walls 33 of the fixture bases 25. Then, the convex protrusions 75 of the printing plate 73 press the indicia region of the main body of the transfer paper tabs 67 against the top surface of the underlying keys and the front surface of the wedge protrusions **75*b* press the indicia region of the flaps 69 against the front surfaces of the keys. The pressure supplied by the platen plus the heat of the printing plate causes the dyes to sublimate and their images to transfer to the keys. The transfer keys may be heated to 380°–410° F. and the platen may press the transfer paper against the keys with a 1–2 psi force for 30 seconds or more, for example, under the control of a suitable controller (not shown). In addition to locating the keys during printing, the key cap locator plate 27 functions as a heat shield that prevents the heat produced by the platen from warping the housing in which the keys are mounted. After the printing cycle has timed out, the platen is automatically raised and the fixture 23** with the printed keyboard removed.

In summary, the invention provides an improved diffusion printer for printing indicia on the keys of an assembled keyboard. The improvement resides in the ability to simultaneously print indicia on one of the side, e.g., the front, surfaces as well as the top surface of the keys.

While a preferred embodiment of the invention has been illustrated and described, it will be appreciated that various changes can be made therein without departing from the spirit and scope of the invention. For example, rather than one keyboard being printed at a time, the invention can be utilized in a printer of the type described in U.S. patent application Ser. No. 725,924 referenced above, wherein several keyboards are simultaneously printed. Further, rather than using a precisely machined printing plate and an underlying rubber blanket, the printing plate can be molded and covered with a layer of protective material as also described in U.S. patent application Ser. No. 725,924. Consequently, the invention can be practiced otherwise than as specifically described herein.

The embodiments of the invention in which an exclusive property or privilege is claimed are defined as follows:

1. A diffusion printer for creating indicia in the top and at least one side surface of the assembled blank keys of a keyboard comprising:

(A) a hot stamp press including a support table and a heated platen mounted above and vertically movable toward said support table;

(B) a fixture located on said support table beneath said heated platen for holding a keyboard included assembled blank keys that are to receive indicia, said fixture including:

(1) a fixture base for receiving said keyboard including assembled blank keys that are to receive indicia, said fixture base including compression means located beneath and aligned with each of said keys that are to receive indicia for applying compression pressure separately to the bottom of each of said keys; and, (2) a locator plate mounted on said fixture base for surrounding and maintaining alignment of the surfaces of said assembled blank keys that are to receive indicia;

(C) a sheet of transfer paper situated atop said assembled blank keys, said sheet of transfer paper including regions of indicia images formed of dry dye suitable for diffusion printing into said keys under heat and pressure, said dry dye indicia image regions being separated from the main body of said transfer paper and positioned in alignment with said top and at least one side surface of each of said assembled blank keys that are to receive indicia on said top and at least one side surface; and, (D) a printing plate attached to the bottom of said heated platen for transferring heat from said heated platen to said sheet of transfer paper and said assembled blank keys that are to receive indicia when said heated platen is lowered, said printing plate including a plurality of rigid protrusions positioned in alignment with the indicia receiving top and at least one side surface of said assembled blank keys of a keyboard that are to receive indicia on the top and at least one side surface held in said fixture for pressing the dry dye indicia images of said transfer paper against said top and at least one side surface when said heated platen is lowered toward said support table.

2. A diffusion printer as claimed in claim 1, wherein said printing plate protrusions include key top protrusions positioned and configured to fit the tops of said keys and key side protrusions positioned and configured to fit said at least one side of said keys.

3. A diffusion printer as claimed in claim 2, wherein said key top protrusions are convex protrusions.

4. A diffusion printer as claimed in claim 3, wherein said key side protrusions are wedge shaped.

5. A diffusion printer as claimed in claim 1, wherein said dry dye indicia images are separated from the main body of said sheet of transfer paper by U-shaped incisions resulting in the formation of tabs containing said dry dye indicia images.

6. A diffusion printer as claimed in claim 5, wherein said printing plate protrusions include key top protrusions configured to fit the tops of said keys and key side protrusions configured to fit said at least one side of said keys.

7. A diffusion printer as claimed in claim 6, wherein said key top protrusions are convex protrusions.

8. A diffusion printer as claimed in claim 7, wherein said key side protrusions are wedge shaped.

9. A diffusion printer as claimed in claim 5, wherein said tabs containing said dry dye indicia include flaps that contain the indicia to be printed on said at least one side surface of said keys.

10. A diffusion printer as claimed in claim 9, wherein said printing plate protrusions include key top protrusions configured to fit the tops of said keys and key side protrusions configured to fit said at least one side of said keys.

11. A diffusion printer as claimed in claim 10, wherein said key top protrusions are convex protrusions.

12. A diffusion printer as claimed in claim 11, wherein said key side protrusions are wedge shaped.

* * * * *